United States Patent [19]

Roehrs

[11] Patent Number: 5,048,636

[45] Date of Patent: Sep. 17, 1991

[54] LOW NOISE WALLBOX FOR SOOTBLOWER

[75] Inventor: Eugene W. Roehrs, Lancaster, Ohio

[73] Assignee: Harness, Dickey & Pierce, New Orleans, La.

[21] Appl. No.: 476,337

[22] Filed: Feb. 7, 1990

[51] Int. Cl.[5] ..... F23M 11/02

[52] U.S. Cl. ..... 181/272; 110/179

[58] Field of Search ..... 181/248, 250, 272, 275; 110/179, 175 R

[56] References Cited

U.S. PATENT DOCUMENTS

| | | | |
|---|---|---|---|
| Re. 22,283 | 3/1943 | Bourne | 181/248 |
| 2,185,450 | 5/1938 | Wager | 285/30 |
| 2,191,620 | 2/1990 | Muller | 181/250 |
| 2,477,334 | 7/1949 | Hibner et al. | 285/30 |
| 2,803,848 | 8/1957 | De Mart | 15/317 |
| 2,804,032 | 8/1957 | Cantieri et al. | 110/179 |
| 2,904,125 | 9/1959 | Bourne et al. | 181/248 |
| 2,988,024 | 6/1961 | Harris | 110/179 |
| 3,385,605 | 5/1968 | Hylbert et al. | 277/70 |
| 4,093,242 | 6/1978 | Terry | 277/58 |
| 4,203,503 | 5/1980 | Franco et al. | 181/272 |
| 4,712,644 | 12/1987 | Sun | 181/275 X |
| 4,750,548 | 6/1988 | Albers et al. | 165/95 |

*Primary Examiner*—Russell E. Adams
*Assistant Examiner*—Jae N. Noh
*Attorney, Agent, or Firm*—Harness, Dickey & Pierce

[57] ABSTRACT

A sootblower wallbox assembly for decreasing noise emissions during the cleaning of a heat exchanger apparatus. In particular, the invention relates to a wallbox assembly containing a number of reverberant chambers exhibiting varying attenuation characteristics. When a cleaning lance is extended centrally through the wallbox assembly, a baffle portion of each chamber is in close fit relation with the exterior surface of the lance. Each reverberant chamber has a different axial length and therefore exhibits a different frequency range where it achieves its best sound attenuation. The wallbox assembly can also be provided with control systems to prevent combustion products from escaping the heat exchanger through the assembly.

22 Claims, 2 Drawing Sheets

LOW NOISE WALLBOX FOR SOOTBLOWER

BACKGROUND AND SUMMARY OF THE INVENTION

The present invention relates generally to a retracting sootblower wallbox sealing assembly for an opening in the wall of a large scale boiler. More specifically, the present invention is directed to a sootblower wallbox constructed to absorb noise emanating from the nozzle of a retractable sootblower lance.

To optimize the thermal efficiency of a heat exchanger or boiler, it is necessary to periodically remove deposits such as soot, slag and flyash from the interior heat exchanging surfaces of the boiler. Typically, a number of cleaning lances, also known as sootblowers, are mounted exteriorly of the boiler and are inserted periodically into the boiler through ports located in the boiler wall. Positioned on the forward end of the lances are one or more cleaning nozzles. The nozzles discharge a pressurized cleaning medium, such as air, steam or other solutions. The effects of the high pressure cleaning medium are such that deposits of soot, slag and flyash are dislodged from the internal structures of the boiler.

Conventional wallbox assemblies serve a number of purposes. One purpose being that of a support structure for the previously mentioned cleaning lances. During cleaning, numerous combustion by-products escape to the exterior of the boiler between the cleaning lance and the walls of the cleaning port. For this reason, another purpose of a wallbox assembly is to retain combustion by-products within the boiler.

Wallbox assemblies designed to retard the escape of combustion by-products generally incorporate two chambers, a sealing air chamber and an aspirating air chamber. Both chambers provide air to the wallbox at a pressure greater than the internal operating pressure of the boiler. When the sootblower lance is dispensed through the wallbox for cleaning, positive pressure sealing air is provided to the wallbox assembly. Once the cleaning lance is removed, aspirating air is directed interiorly of the heat exchanger through an annular array of ports. The orientation of the aspirating ports, along with the increased pressure of the aspirating air, restricts the flow of combustion by-products from the cleaning port during normal operation of the boiler.

While being effective for their intended functions, modern sootblower systems tend to exhibit high noise emissions. In addition to normal operational noise of the boiler, noise is generated as the cleaning medium exits the lance nozzle during a cleaning cycle. The cleaning noise escaping from the wallbox assembly can generate extensive sound pressure outside the boiler.

In view of the foregoing, a principle object of the present invention is to provide a wallbox assembly which effectively limits the noise emissions associated with sootblower operation.

Another object of the present invention is to provide a wallbox assembly of a simple construction which thereby facilitates fabrication, service and maintenance.

A further object of the present invention is to provide a wallbox assembly capable of reducing noise emissions while also preventing the emission of combustion by-products from the assembly.

In the present invention, a sootblower wallbox assembly is provided with a number of sound absorbing reverberant annular chambers which surround the sootblower lance. The chambers are positioned coaxially and are bounded by baffle rings in close fit relation with the outside diameter of the lance. In order to achieve the desired sound attenuation characteristics, each chamber has a specific frequency range where it achieves its most significant noise reduction.

Since the reverberant chambers reduce noise by negative reinforcement, each chamber has its best noise absorption centered about a frequency having a wavelength four times the length of the chamber. From this it can be noted that a plurality of chambers having various lengths must be provided in order to obtain noise reduction throughout the audible frequency range. In designing a wallbox assembly having a minimum number of resonating chambers, care must be taken in choosing chamber lengths so that each chamber will significantly increases the overall effective attenuation of the assembly.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 4(*e*) displays the overall attenuation curve for a three chamber wallbox assembly having chamber lengths corresponding to the attenuation curves of FIGS. 4(*a*), 4(*b*) and 4(*d*).

DESCRIPTION OF THE DRAWINGS

The following description applies generally to all of the embodiments of the present invention. Therefore, where appropriate, like elements are given like referenced numbers.

Figure 1:
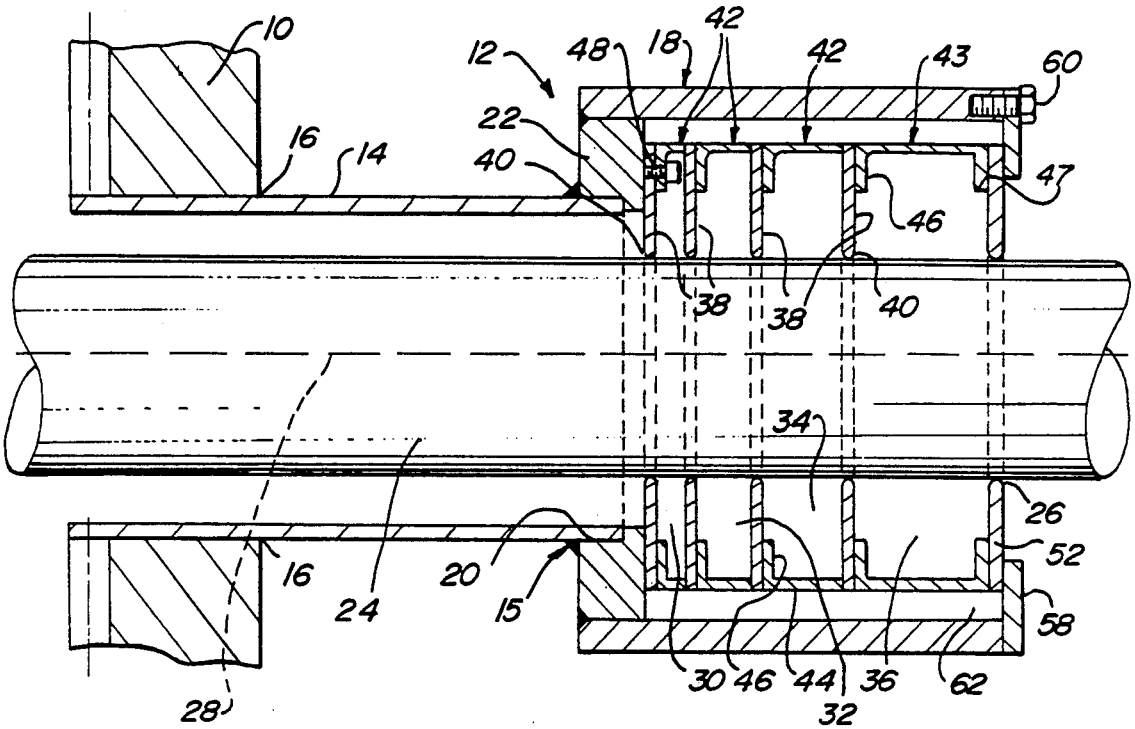
FIG. 1 is a side sectional view of a four chamber embodiment of the present invention having a cleaning lance disposed therethrough.

Referring now to the drawing, in FIG. 1, a wallbox assembly, generally designated as 12, is illustrated as being mounted exteriorly of a boiler upon a sleeve pipe 14 extended through a cleaning port 16 in a boiler wall 10. An exterior housing 18 of the assembly 12 is rigidly secured to the outer and rearward end 15 of the sleeve pipe 14 by welding or other conventional securement means. Located on a forward face 22 of the housing 18 is a rim 20. The rim 20 is in nesting engagement with the outer most portion of the sleeve pipe 14. During mounting of the wallbox 12, the rim 20 prohibits overinsertion of the sleeve pipe 14 and possible damage to the internal structures of the wallbox 12. The forward face 22 may be separately secured to the housing 18 as seen in FIG. 1, or alternatively, the forward face 22 may be formed or cast integral with the remainder of the housing 18 as seen in FIG. 2.

A cleaning lance 24 is inserted from the exterior side of the wallbox 12 through a lance opening 26 until extended into the boiler through the wallbox 12, sleeve pipe 14 and boiler wall 10. The lance 24 thus defines an axis of insertion 28 for the assembly 12.

Figure 2:
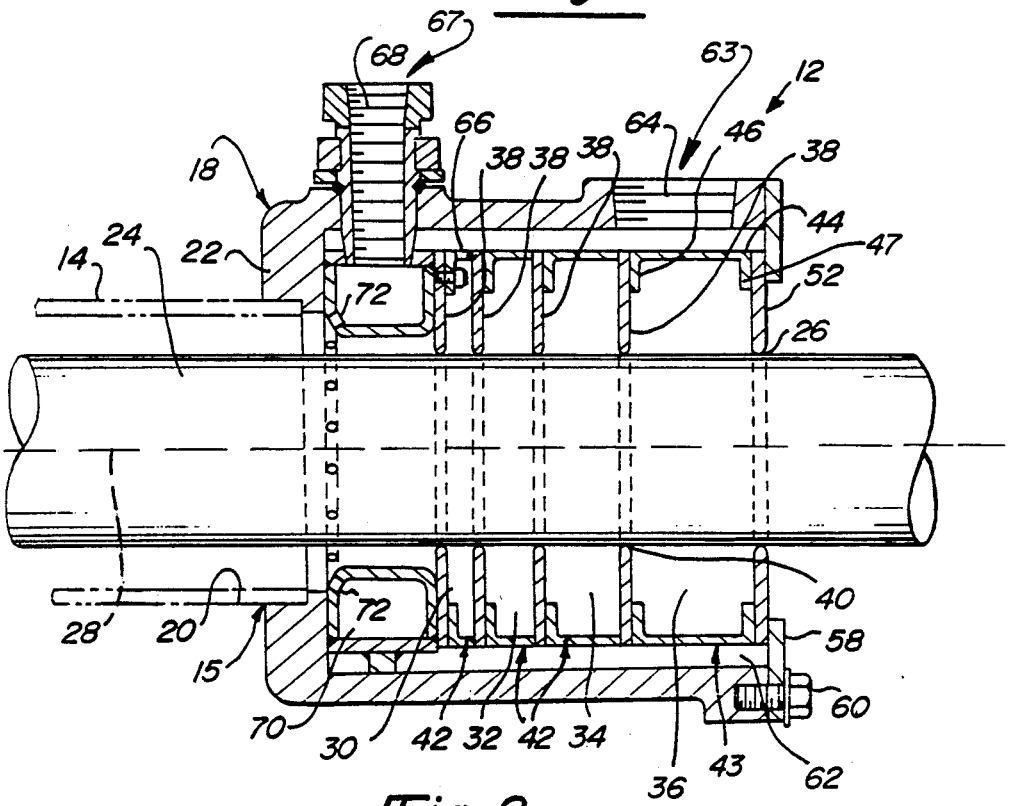
FIG. 2 is a side sectional view of a four chamber embodiment further including an air seal and an aspirating seal.
Figure 3:
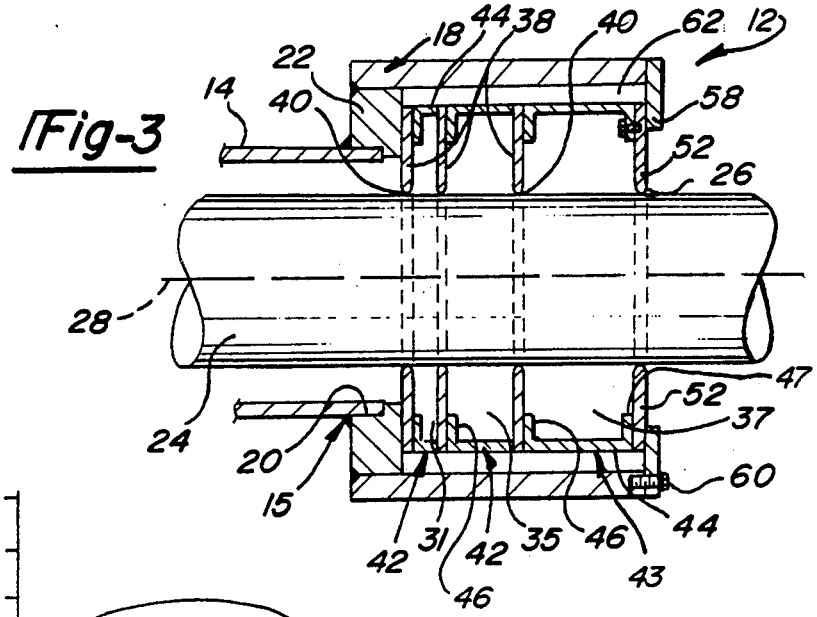
FIG. 3 is a side sectional view of a three chamber embodiment of the noise reducing wallbox of the present invention.

FIGS. 1 and 2 illustrate four chamber embodiments of the present invention. FIG. 3 illustrates a three chamber embodiment. Each sound absorbing chamber varies as to length and are designated as chambers 30, 32, 34 and 36 in FIGS. 1 and 2 and as chambers 31, 35 and 37 in FIG. 3. While the chambers are shown in a sequential arrangement, the order of chamber lengths does not affect the attenuation efficiency of the wallbox 12.

Except for length, each sound absorbing chamber is structurally similar and defined by a spacer ring 42 and one or more baffle rings 38. Each baffle ring 38 has a centrally located annular opening 40 which corresponds to the lance opening 26. The baffle rings 38 are positioned transversely to the axis of insertion 28 and are coaxial with the cleaning lance 24. Thus, the lance 24 may be inserted consecutively through each chamber. The inner diameters of the annular openings 40 are such that each baffle ring 3 is in close fit relation with the exterior surface of the lance 24.

The length of each chamber is varied by the use different size spacer ring 42. Except for the rearmost spacer ring 43, each spacer ring 42 consists of two portions, an axial portion 44 and a transverse flange portion 46. The rearmost spacer ring 43 varies only in that it contains an additional flange portion 47 as will be explained below. The axial portions 44 are positioned so as to be coaxial with the lance 24 when it is extended through the assembly 12. Each flange portion 46 extends transversely from one end of the axial portion 44. The flange portion 46 fastens the spacer ring 42 to the baffle ring 38 through the use of bolt fasteners 48 or other conventional fastening means. For the sake of clarity, only one bolt fastener 48 is shown in the figures. The remaining chambers are constructed in a similar fashion.

As an alternative to the construction described above, each sound absorbing chamber could be constructed of a singularly cast part, including both the spacer ring 42 and baffle ring 38, or the entire series of chambers could be cast as a unitary part.

Once assembled, the baffle ring 38 of the front chamber 30 is positioned closest to the interior of the boiler. A portion of the front chamber baffle ring 38 is in contacting relation, opposite of the rim 20, with the interior surface of the forward face 22 of the housing 18. A first middle chamber 32 is positioned adjacent to the front chamber 30 against baffle ring 38. The remaining chambers are mounted in like fashion to form a series of sound absorbing chambers all having a common exterior surface coaxial to the cleaning lance 24.

A rear baffle ring 52, defining the lance opening 26, forms the rearmost wall of the chamber series. The rear baffle ring 52 is attached to the second flange portion 47 of the rear spacer ring 43 in the same manner as the previous baffle rings 38.

While the baffle rings 38 and 52 are shown mounted exteriorly to the flange and axial portions 46 and 44, it is readily seen that the baffle rings 38 and 52 may alternatively be mounted interiorly, relative to the flange portion 46 and 47. Constructed in this manner, the dog portion 46 of the first chamber 30 would be in contacting relationship with the inner surface of the forward face 22 and the dog portion 47 of the rear chamber 36 would contact an exterior cover plate 58.

The rear baffle ring 52 along with the other baffle rings also function as a scraper for the lance 24. During the cleaning cycle, sootblower lance 24 is extended into the boiler and retracted as a cleaning medium is sprayed from the lance nozzle block (not shown). Frequently, the lance tube 24 is rotated simultaneous with its axial travel. Throughout the cleaning cycle and during dwell periods between actuation, some portion of lance tube 24 is within wallbox 12. During retraction of lance tube 24, the baffle ring 52 abrasively dislodges deposits, such as fly ash and salt cake, that have adhered to the exterior surface of the lance 24.

The sound absorbing chambers of wallbox 12 are secured within the housing 18 by a cover plate 58. The cover plate 58 is fastened to the housing 18 by bolt fasteners 60 or another conventional attachment means. Again, one bolt fastener 60 is shown for the sake of clarity. Thus, the cover plate 58 and rear baffle ring 52 form the rear wall of the housing 18. So mounted, the sound absorbing chambers 30, 32, 34 and 36 are held in position by the pressure exerted on them through the cooperation of the forward face 22 and the cover plate 58. This mounting enables the chamber series to be capable of some transverse movement or self alignment in response to a corresponding movement of the cleaning lance 24.

As mentioned previously, the outermost surfaces of the spacer rings 42 cooperate to form a common exterior surface of the chamber series. However, it should be noted that the overall exterior diameter of the chamber series is less than the interior diameter of the housing 18 and thus, an air space 62 is defined therebetween. The air space 62 assists in sealing the wallbox assembly 12 to prevent the escape of combustion by-products from the interior of the heat exchanger. The air space 62 will be described in greater detail below.

FIG. 2 illustrates a second embodiment of the wallbox assembly 12 of the present invention. The embodiment of FIG. 2 is a four chamber reverberant wallbox assembly 12 incorporating both a positive pressure air seal 63 and a positive pressure aspirating seal 67. Much of the structure illustrated in FIG. 2 is concurrent with that of FIG. 1 and is therefore designated with like references. Each sealing system 63 and 67 assists in preventing the escape of combustion by-products from the boiler and is readily adaptable to the three chambered wallbox assembly 12 illustrated in FIG. 3.

When the cleaning lance 24 is in use and moving through the wallbox 12, positive pressure sealing air is provided by an air source (not shown) through a supply inlet 64 to the air space 62 and subsequently through a sealing air port 66 in one (or more) of the spacer rings 42. The seal air is provided at a pressure greater than the internal operating pressure of the boiler. While the seal air port 66 is shown in the foremost chamber 30, it could be alternatively provided in any of the remaining chambers without affecting the systems operational capabilities.

When the cleaning lance 24 is removed from the wallbox 12 for replacement or maintenance, the sealing air system 63 is inadequate at retaining the combustion by-products. Therefore, the aspirating seal 67 is provided. The aspirating seal 67 is positioned forward of the first reverberant chamber 30 and consists of an aspirating air inlet 68 and an aspirating ring 70. The aspirating ring 70 is provided with a number of aspirating ports 72 which circumferentially encircle the cleaning lance 24 during its insertion into the heat exchanger. The aspirating ports 72 are positioned equidistantly around the ring 70 and are oriented toward the interior of the heat exchanger. When the lance 24 is not in use, aspirating air is provided through the aspirating inlet 68 at a pressure significantly greater than the internal operating pressure of the heat exchanger. The combination of the aspirating air's orientation and increased pressure is effective so as to prevent the emission of combustion by-products through the sleeve pipe 14 during normal operation of the heat exchanger.

While incorporated into FIG. 2, it should be noted that neither the aspirating air system 67 or the seal air system 63 contributes to the overall sound attenuation capabilities of the wallbox assembly 12.

When constructing the wallbox assembly 12 of the present invention, care should be taken so that the chamber lengths are not arbitrarily chosen. Depending upon its length, as measured by the distance between adjacent baffle rings 38, each chamber has a specific frequency range where its most significant attenuation is achieved. As mentioned previously, attenuation is accomplished by negative reinforcement and the best absorption for each cavity will be centered about a frequency (and overtones of this frequency) having a wavelength four times the chamber length. In contrast, a frequency having a half wavelength equal to the length of the cavity will not be attenuated significantly. While chamber length determines the frequency range of attenuation, the radial height of the chamber determines the magnitude of this attenuation. Thus, as radial height increases, attenuation also increases.

Figure 4:
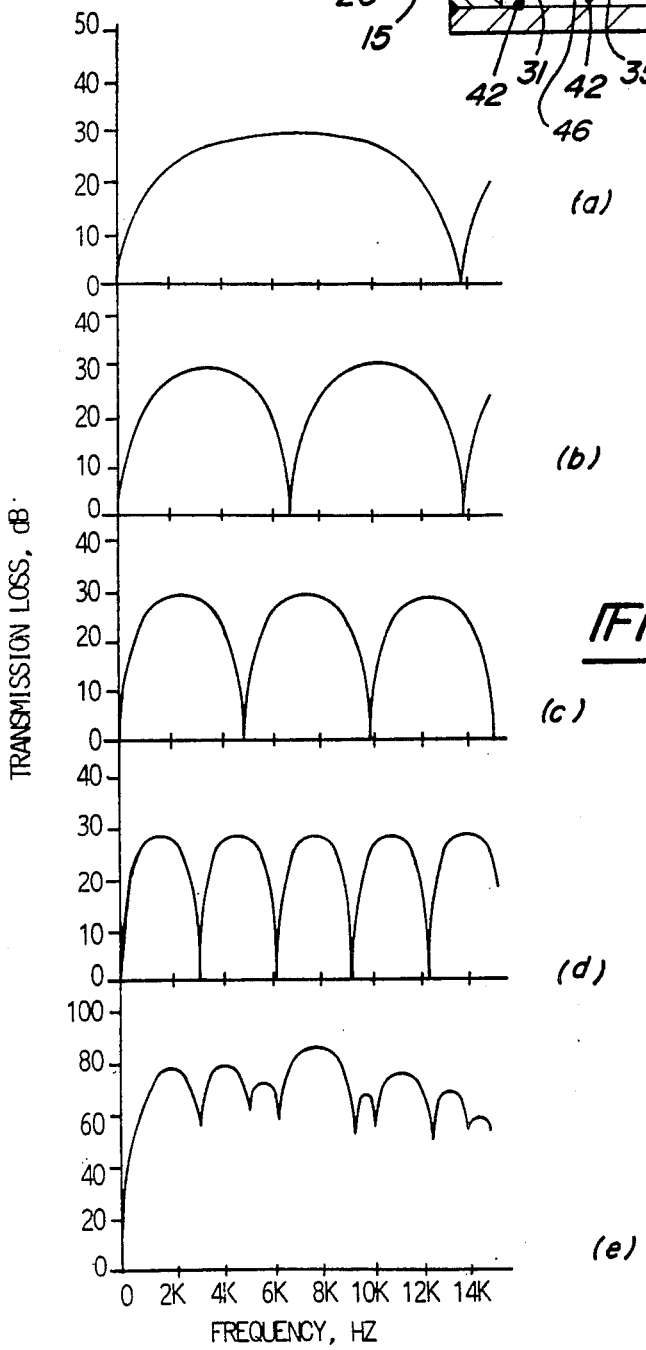
FIGS. 4(*a*)–4(*d*) display attenuation curves for various chamber lengths of the noise reducing wallbox of the present invention.

As seen in FIG. 4, the attenuation curve for each cavity is a sine-squared curve, repeating for overtones of the attenuated frequency. Thus, the attenuation curve for each chamber is a series of peaks and valleys, the peaks representing maximum attenuation. FIG. 4(*a*) illustrates the attenuation curve for a chamber having a ½ inch axial length. FIG. 4(*b*) is the attenuation curve corresponding to a 1 inch axial chamber length. The attenuation curves for axial chamber lengths of 1⅜ inches and 2¼ inches are respectively shown in FIGS. 4(*c*) and 4(*d*) respectively. FIG. 4(*e*) shows the overall attenuation for a three chamber reverberate wallbox assembly (FIG. 3) having axial chamber lengths of ½, 1⅜ and 2¼ inches.

For effective noise reduction, a wide variation in chamber lengths is required. An observer might notice that the attenuation curve for the ½ inch chamber has effective attenuation (attenuation above 20 dB) occurring in a fairly wide frequency range, with valleys at approximately 0 Hz and 14 KHz (see FIG. 4(*a*)). Upon seeing this wide effective range, the observer would probably want to employ a number of chambers of this size and omit the larger chambers. Such an approach is problematic in that the attenuation curve of the ½ inch chamber exhibits a slow rise from 0 Hz to 2 KHz. Occupational Safety and Health Administration (OSHA) regulations, and most other criteria, now use what is known as the A-weighted sound curve in measurements that relate directly to human responses to noise, both from the viewpoint of hearing damage and annoyance.

When subjectively evaluating the impact of noise upon the human ear, A-weighted curve values are added to the raw sound pressure levels. When using the A-weighted curve, raw sound levels are decreased in certain frequency ranges and increased in others to arrive at a composite sound level measure. In the range of 500 Hz to 16 KHz, the A-weighted curve has little attenuation. Thus, the attenuation of the ½ inch chamber is ineffective in the lower part of this important A-weighted range. By comparison, the attenuation curve for the 2¼ inch chamber (FIG. 4(*d*)) displays a much quicker rise and is above the 20 dB effective attenuation level from about 375 Hz to 2.7 KHz. Thus, the 2¼ inch chamber provides that which the ½ inch chamber lacks, namely, significant attenuation in the lower part of the critical A-weighted frequency range.

In determining overall attenuation for a series of reverberant chambers, the attenuation curves for the respective chambers lengths are added together. Thus, FIG. 4(*e*) represents the sum of FIGS. 4(*a*),(*b*) and (*d*). With this in mind, it can be seen that chamber lengths should not be changed indiscriminately. An alteration of length which causes the valleys of two attenuation curves to coincide would significantly lessen the overall attenuation of the assembly. For example, if the 2¼ inch chamber was shortened to 2⅛ inches, the valley of the attenuation curve at approximately 9 KHz would shift out to almost 10 KHz where the attenuation curve for the 1⅜ inch chamber also has a valley. A four chamber wallbox incorporating a ½ inch, 1 inch, and 1⅜ inch chamber would be more effective with a 2¼ inch fourth chamber, rather than 2⅛ inch fourth chamber. In theory, the overall attenuation for the assembly 12 would differ by approximately 10 dB at that frequency.

While the above description constitutes the preferred embodiments of the present invention, it will be appreciated that the invention is susceptible to modification, variation and change without departing from the proper scope and fair meaning of the accompanying claims.

I claim:

1. A sootblower wallbox assembly for diminishing noise emissions emanating from a cleaning port of a heat exchanger while also providing a lance tube element access to an interior area of the heat exchanger, the assembly comprising:

two or more generally closed reverberant sound absorbing chambers surrounding said lance tube and arranged in side-by-side relation along the longitudinal axis of said lance tube and separated by at least one plate having a passageway for said lance tube in close fit relation, said lance tube extending through said chambers so as to define an interiormost wall thereof, said chambers attenuating sound transmitted into said wallbox from said heat exchanger, said chambers being hollow and having differing dimensional configurations enabling each chamber to exhibit differing resonance and sound absorbing characteristics whereby said wallbox provides a total sound attenuation which is a sum of the sound absorbing characteristics of said reverberant chambers.

2. A sootblower wallbox assembly for diminishing noise emissions as set forth in claim 1 wherein said reverberant chamber configurations vary in axial length.

3. A sootblower wallbox assembly for diminishing noise emissions as set forth in claim 1 wherein said reverberant chambers are in side by side coaxial relation with said lance tube.

4. A sootblower wallbox assembly for diminishing noise emissions as set forth in claim 1 wherein said reverberant chambers are generally annular.

5. A sootblower wallbox assembly for diminishing noise emissions as set forth in claim 1 having three reverberant chambers.

6. A sootblower wallbox assembly for diminishing noise emissions as set forth in claim 1 having four reverberant chambers.

7. A sootblower wallbox assembly for decreasing noise emissions exiting around a cleaning lance extended through said assembly during cleaning of a heat exchanger, said assembly comprising a plurality of generally closed annular resonance chambers surrounding said cleaning lance in coaxial arrangement such that said cleaning lance defines an interiormost wall of said chambers, said chambers being of differing axial lengths enabling said chambers to exhibit differing sound attenuation characteristics whereby an overall sound attenuation of said assembly is a sum of the sound attenuation characteristics of said chambers.

8. A sootblower wallbox assembly for decreasing noise emissions as set forth in claim 7 wherein said resonance chambers are in side by side arrangement around said cleaning lance.

9. A sootblower wallbox assembly for decreasing noise emissions as set forth in claim 7 having three of said resonance chambers.

10. A sootblower wallbox assembly for decreasing noise emissions as set forth in claim 9 wherein a first resonance chamber has an axial length of about ½ inch, a second resonance chamber has an axial length of about 1⅜ inches, and a third resonance chamber has an axial length of about 2¼ inches.

11. A sootblower wallbox assembly for decreasing noise emissions as set forth in claim 9 wherein a first resonance chamber has significant sound attenuation for frequencies in a range of about 1.6 KHz to 12.2 KHz and overtones thereof, a second resonance chamber has significant sound attenuation for frequencies in a range of about 0.5 KHz to 4.5 KHz and overtones thereof, and a third resonance chamber has significant sound attenuation for frequencies in a range of about 0.3 KHz to 2.7 KHz and overtones thereof.

12. A sootblower wallbox assembly for decreasing noise emissions as set forth in claim 7 having four resonance chambers.

13. A sootblower wallbox assembly for decreasing noise emissions as set forth in claim 12 wherein a first resonance chamber has an axial length of about ½ inch, a second resonance chamber has an axial length of about 1 inch, a third resonance chamber has an axial length of about 1⅜ inches, and a fourth resonance chamber has an axial length of about 2¼ inches.

14. A sootblower wallbox assembly for decreasing noise emissions as set forth in claim 12 wherein a first resonance chamber has significant sound attenuation for frequencies in a range of about 1.6 KHz to 12.2 KHz and overtones thereof, a second resonance chamber has significant sound attenuation for frequencies in a range of about 0.8 KHz to 6.2 KHz and overtones thereof, a third resonance chamber has significant sound attenuation for frequencies in a range of about 0.5 KHz to 4.5 KHz and overtones thereof, and a fourth resonance chamber having significant sound attenuation for frequencies in a range of about 0.3 KHz to 2.7 KHz and overtones thereof.

15. A sootblower wallbox assembly for decreasing noise emissions as set forth in claim 7 wherein said assembly further comprises a sealing air inlet extending interiorly through at least one of said resonance chambers whereby said chamber is provided with positive pressure air to seal said wallbox assembly when said lance tube is extended through said assembly.

16. A sootblower wallbox assembly for decreasing noise emissions as set forth in claim 7 wherein said assembly further comprises an aspirator having an aspirating air inlet terminating in a generally annular aspirator baffle surrounding said cleaning lance, said aspirator baffle having portions defining a plurality of aspirating ports oriented in a direction generally internally of said heat exchanger whereby said aspirating air inlet provides positive pressure air to said aspirating ports when said lance tube is removed from said assembly.

17. A sootblower wallbox assembly for decreasing sound emissions during cleaning of a heat exchanger by a cleaning lance extended through said assembly, said assembly comprising:

a plurality of generally closed sound reducing annular chambers surrounding said cleaning lance in side by side coaxial arrangement, said cleaning lance being extendable through said chambers and defining innermost walls of said chambers, said chambers being of generally equal diameter and varying in axial length to differ the sound reducing characteristics of said chambers whereby said assembly has an overall sound reduction capability which is a sum of the sound reducing characteristics of said chambers; and means for substantially preventing combustion products and gases from exiting said heat exchanger by passing through said assembly.

18. A sootblower wallbox assembly for decreasing sound emissions as set forth in claim 17 having three sound reducing chambers.

19. A sootblower wallbox assembly for decreasing sound emissions as set forth in claim 18 wherein a first sound reducing chamber has an axial length of about ½ inch, a second sound reducing chamber has an axial length of about 1⅜ inches, and a third sound reducing chamber has an axial length of about 2¼ inches.

20. A sootblower wallbox assembly for decreasing sound emissions as set forth in claim 17 having four sound reducing chambers.

21. A sootblower wallbox assembly for decreasing sound emissions as set forth in claim 20 wherein a first sound reducing chamber has an axial length of about ½ inch, a second sound reducing chamber has an axial length of about 1 inch, a third sound reducing chamber has an axial length of about 1⅜ inches, and a fourth sound reducing chamber has an axial length of about 2¼ inches.

22. A sootblower wallbox assembly for decreasing sound emissions as set forth in claim 17 wherein said means preventing the exiting of combustion products includes a housing substantially enclosing said sound reducing chambers and having a diameter greater than said chambers to define an air space therebetween, an air seal having a sealing air inlet extending through said housing to said air space and an sealing air passage extending into one or more of said chambers whereby said air seal provides positive pressure air to one or more of said chambers when said lance is extended through said assembly, an aspirating seal including an aspirating inlet extending through said housing and terminating in an annular aspirating ring, said aspirating ring being coaxial with said lance extending therethrough, said aspirating ring further having portions defining a plurality of aspirating ports generally oriented interiorly of said heat exchanger whereby said aspirating seal provides positive pressure air to said aspirating ports when said lance is removed from said assembly.

* * * * *